United States Patent [19]

Schulz

[11] Patent Number: 5,028,051

[45] Date of Patent: Jul. 2, 1991

[54] PUTTING PRACTICE DEVICE

[76] Inventor: Eric R. Schulz, 437 24th St., Hermosa Beach, Calif. 90254

[21] Appl. No.: 634,964

[22] Filed: Jan. 3, 1991

Related U.S. Application Data

[63] Continuation-in-part of Ser. No. 612,259, Nov. 13, 1990, abandoned.

[51] Int. Cl.[5] ..... A63B 69/36

[52] U.S. Cl. ..... 273/183 C; 273/34 B; 273/186 B; 273/200 B; 273/185 D

[58] Field of Search ..... 273/183 C, 184 R, 185 R, 273/185 D, 186 R, 186 B, 186 C, 200 B, 34 R, 34 B

[56] References Cited

U.S. PATENT DOCUMENTS

| | | | |
|---|---|---|---|
| 1,074,880 | 10/1913 | Lynch | 273/185 D |
| 2,656,720 | 10/1953 | Sonnett | 273/185 D X |
| 3,165,930 | 1/1965 | Halpern et al. | 273/183 C X |

*Primary Examiner*—George J. Marlo
*Attorney, Agent, or Firm*—Robert M. Sperry

[57] ABSTRACT

A putting practice device (10) that may be used indoors or outdoors to improve a golfers putting. The device (10) consists of a putting surface (14) having therein a golf cup (16), a first golf ball (20) pivotally mounted adjacent one edge of the cup, a lever (30) coupled to the first golf ball (20) to facilitate movement of the first golf ball out of the cup (16), a second golf ball (40) positioned adjacent the opposite edge of the cup (16) from the first golf ball (20), and indicia showing desired movement of a golf club during a proper putting stroke. When the first ball (20) is struck, it pivotally falls into the cup (16) and the "follow through" will then strike the second ball (40). If the "follow through" is correct the second ball will continue in a straight path; if not, the ball (40) will go to one side or the other indicating a correctable problem.

12 Claims, 2 Drawing Sheets

PUTTING PRACTICE DEVICE

CROSS REFERENCE TO RELATED APPLICATION

This application is a continuation-in-part of application Ser. No. 612,259 filed Nov. 13, 1990, now abandoned.

TECHANICAL FIELD

This invention relates to putting practice devices and is particularly directed to apparatus which may be used to practice putting either indoors or outdoors.

BACKGROUND ART

As is well known, the game of golf is difficult to master and devotees spend considerable amounts of time in practicing the various strokes which are needed during a game. One of the most subtle of these strokes, and one which requires the most practice, is the putt. For this purpose, putting practice greens are provided at most golf courses. Furthermore, numerous devices have been proposed heretofore to enable golfers to obtain practice putting indoors, such as at home. Many of the putting practice devices serve the purpose of sequentially presenting a plurality of golf balls to enable the golfer to shoot a series of putts. Other prior art putting practice devices serve to indicate the angle with which the club strikes the ball as a guide to the resulting motion which this will cause as the ball moves.

A search of the prior art did not disclose any patents that read directly on the claims of the instant invention however, the following U.S. patents were considered related:

| U.S. Pat. No. | INVENTOR | ISSUED |
|---|---|---|
| 3,510,136 | Ruspoli, E. | 5 May 1970 |
| 3,894,739 | Goldstein, R. | 15 July 1975 |
| 4,194,648 | Stanton, R. | 25 March 1980 |

The patents to Ruspoli and Stanton each disclose devices for sequentially presenting a plurality of balls, while the device of Goldstein serves to indicate whether the club is properly aligned as it strikes the ball. However, none of these references provides any indication of the movement of the club after it strikes the ball. On the other hand, as any serious golfer knows, "follow through" is an extremely important factor in any stroke, including putting. Furthermore, none of the prior art putting practice devices are capable of use both indoors and on a golf course.

DISCLOSURE OF THE INVENTION

These disadvantages of prior art putting practice devices are overcome with the present invention and an improved putting practice device is proposed which provides an accurate indication of the stroke and follow through of a putt and which is capable of use both indoors and at a golf course.

The advantages of the present invention are preferably attained by providing an improved putting practice device comprising a surface having a recess formed therein simulating a golf cup, a first golf ball pivotally mounted adjacent one edge of said cup, lever means coupled to said first golf ball to facilitate movement of said first golf ball out of said cup, a second golf ball positionable adjacent the opposite edge of said cup from said first golf ball, and indicia showing desired movement of a golf club during a proper putting stroke. For outdoor use, such as at a golf course, a portion of said surface including said cup, said first golf ball and said lever is removable and is dimensioned to fit within a conventional golf course cup.

Accordingly, it is an object of the present invention to provide an improved putting practice device.

Another object of the present invention is to provide an improved putting practice device which provides a positive indication of whether or not the club is properly oriented as it approaches and passes the ball during a putting stroke.

A further object of the present invention is to provide an improved putting practice device which is capable of use both indoors and outdoors, such as at a golf course.

A specific object of the present invention is to provide an improved putting practice device comprising a surface having a recess formed therein simulating a golf cup, a first golf ball pivotally mounted adjacent one edge of said cup, lever means coupled to said first golf ball to facilitate movement of said first golf ball out of said cup, a second golf ball positionable adjacent the opposite edge of said cup from said first golf ball, and indicia showing desired movement of a golf club during a proper putting stroke. For outdoor use, such as at a golf course, a portion of said surface including said cup, said first golf ball and said lever is removable and is dimensioned to fit within a conventional golf course cup.

These and other objects and features of the present invention will be apparent from the following detailed description, taken with reference to the figures of the accompanying drawing.

BEST MODE FOR CARRYING OUT THE INVENTION

Figure 6:
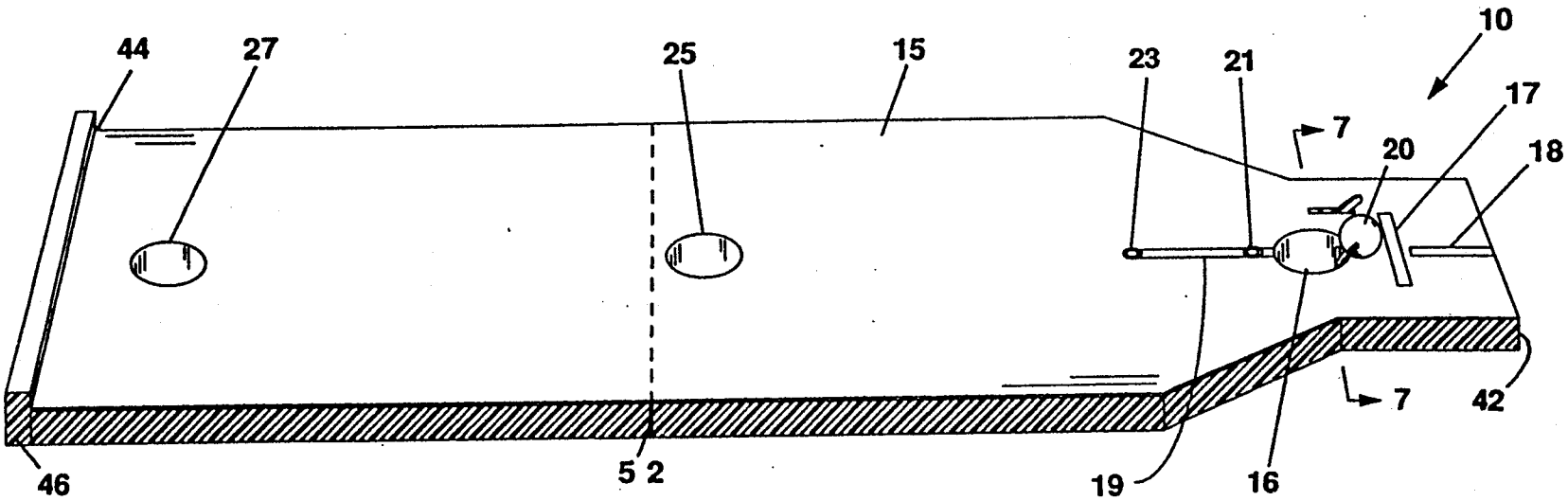
FIG. 6 is an isometric view of the putting practice device having an extended putting surface that includes a putter alignment guide, an aiming line, a follow-through line with ball markers and a pair of target cups.
Figure 7:
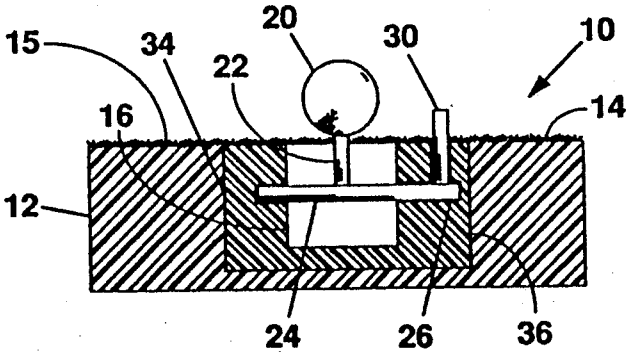
FIG. 7 is a transverse section through the putting practice device taken along the lines 2—2 of FIG. 6.

The best mode for carrying out the putting practice device 10 is presented in terms of a preferred embodiment that is designed to help a new or experienced golfer practice and improve his putting. The preferred embodiment, as shown in FIGS. 6 and 7 is described after the following discussion which covers the mechanics of the device, one form of an indoor device and an outdoor device.

Figure 1:
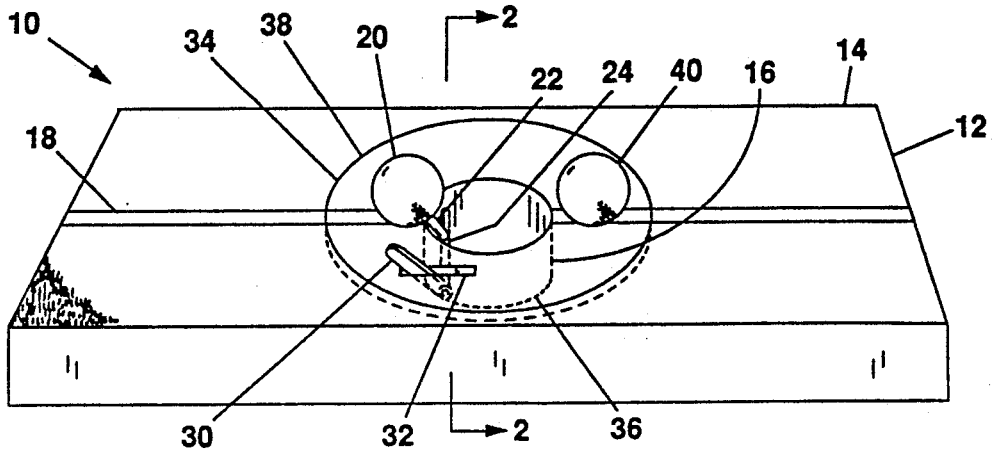
FIG. 1 is an isometric view of a putting practice device embodying the present invention.
Figure 2:
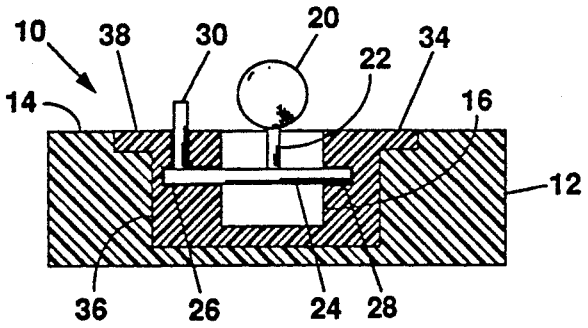
FIG. 2 is a transverse section through the putting practice device taken along the lines 2—2 of FIG. 1.
Figure 3:
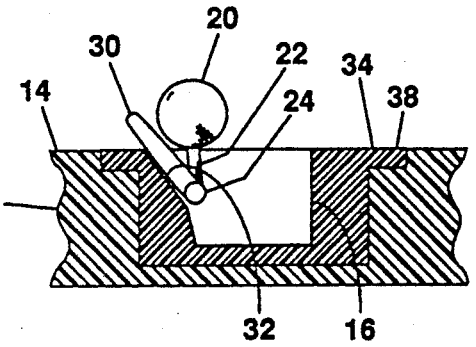
FIG. 3 is a diagrammatic view of a portion of the putting practice device of FIG. 1, showing the first golf ball in its initial position.
Figure 4:
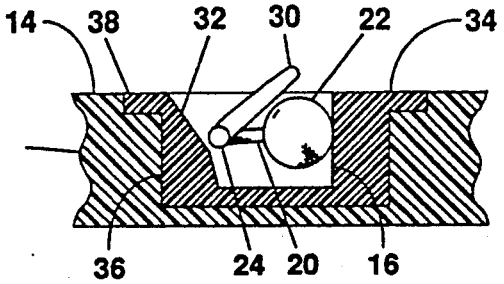
FIG. 4 is a view, similar to that of FIG. 3, showing the first golf ball after a putt.

The putting practice device 10, as shown in FIG. 1 includes a base 12 provided with a putting surface 14, formed of artificial turf, indoor/outdoor carpeting 15 or the like, and having a cup 16 recessed below the putting surface 14. An aiming line 18 is provided, extending lengthwise of the putting surface 14 and bisecting the cup 16. A first golf ball 20 is positioned adjacent one edge of the cup 16 and, as best seen in FIG. 2 is mounted on one end of a shaft 22 which projects perpendicularly form a pivot shaft 24 whose ends are rotatably mounted on opposite sides of the cup 16, as seen at 26 and 28 in FIG. 2. A lever 30 also projects perpendicularly from the pivot shaft 24 and is radially offset, slightly, from the shaft 22 supporting the first golf ball 20, as best seen in FIGS. 3 and 4. The lever 30 is movable within a slot 32 formed in the putting surface 14, as seen in FIGS. 1 and 5.

Figure 5:
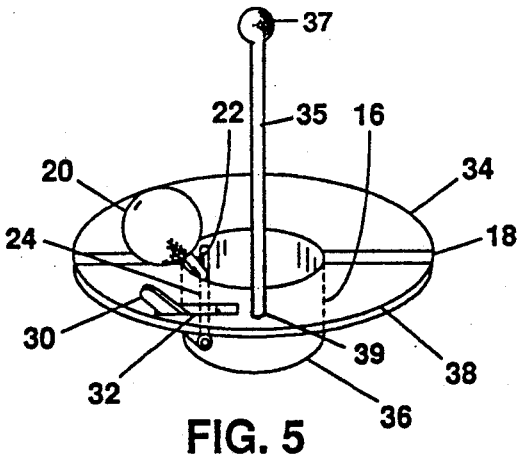
FIG. 5 is an isometric view of the removable portion of the putting practice device of FIG. 1 removed for outdoor use and showing the location of the lift rod.

If desired, a portion 34 of the putting practice device 10, including the cup 16, first golf ball 20, shaft 22, pivot shaft 24, lever 30 and a portion of the putting surface 14 surrounding the cup 16, may be made removable form the practice putting device 10, as seen in FIG. 5. The lower portion 36 of the removable portion 34 is dimensioned to fit within a standard golf course cup, while the surrounding flange 38 serves to support the removable portion 34 from the ground surrounding the golf course cup. Thus, for outdoor use, the user may simply remove the removable portion 34 and carry it to a golf course, whereupon, he places the lower portion 36 in a desired cup of the golf course and proceeds to practice his putting. To facilitate the removable of the portion 34, a lift-rod 35 may be used. As shown in FIG. 5, the lift-rod 35 has an upper end that has a lift knob 37 and a lower end that is attached substantially normal to the upper surface of the golf cup by any attaching means 38 well known in the art.

For indoor use, the removable portion 34 is placed in the base 12, as seen in FIG. 1, and proceeds to practice putting. Obviously, the removable portion 34 could, if desired, be manufactured and sold as an independent unit for outdoor use.

To practice putting with the putting practice device 10, the user positions the first golf ball 20 adjacent the edge of the cup 16, as seen in FIG. 1, and places a second golf ball 40 on the longitudinally located aiming line 18 on the side of the cup 16 opposite from the first golf ball 20. The lever 30 will then be in the left-hand position, as seen in FIGS. 1 and 3. When the user makes a practice stroke, the club will strike the first golf ball 20 and will cause it to swing on arm 22 about the pivot shaft 24 and to fall into the cup 16. As the movement of the club continues, during the "follow-through" portion of the stroke, the club will strike the second golf ball 40. This impact will cause the second golf ball 40 to move along the putting surface 14 a distance dependent upon the force of the stroke. Moreover, depending upon the position of the face of the club at the time of impact with the second golf ball 40, the second golf ball 40 may move directly along the aiming line 28 or may be driven off of the aiming line 18 to one side or the other. Obviously, any movement of the second golf ball 40 off of the aiming line 18 will indicate that the club face was not properly aligned or that the club was turned during the stroke. Either of these conditions is undesirable and suggests that additional practice is needed.

As the first golf ball 20 falls into the cup 16, lever 30 moves from its left-hand position, as seen in FIGS. 1 and 3, to its right-hand position, as seen in FIG. 4, since lever 30 is connected to pivot shaft 24 which, in turn, is connected to shaft 22 and, hence, to first golf ball 20. After the stroke, the user places the club head against the lever 30 and pushes the lever 30 to the left-hand position, as seen in FIGS. 1 and 3. This serves to return the first golf ball 20 to the position shown in FIGS. 1 and 3 in readiness for a subsequent putting stroke.

If the user desires to use the putting practice device 10 outdoors, he may remove the portion 34 and carry it to a suitable location, such as a golf course. As noted above, the lower portion 36 of the removable portion 34 is dimensioned to fit within a standard golf cup, while the flange 38 of the removable portion 34 will rest upon the turf surrounding the standard golf cup. The user may then place the second golf ball 40 on the aiming line 18 on the flange 38 of the removable portion 34 and can proceed to practice putting in the manner described above.

The preferred embodiment of the putting surface device 10, as shown in FIGS. 6 and 7 is comprised of an extended putting surface 14 that preferably consists of indoor/outdoor carpeting 15. The base 12 and putting surface as shown in FIG. 6 includes a front edge 42 and a back edge 44 that includes a ball-stop ledge 46. On the front upper section of the putting surface is located a putter alignment guide 17 that extends laterally across the putting surface 14, just behind the back of the first golf ball 20. An aiming line 18, that also functions as a back-stroke guide, extends longitudinally from the front edge 42 of the putting surface. The line 18 is in alignment with the center of the first golf ball 20 and adjacent to the longitudinal outer edge of the putter alignment guide 17.

A follow-through line 19 is also placed on the putting surface and is aligned with the aiming line 18. The line 19 extends longitudinally from the inner center edge of the golf cup 16 for a distance of up to 18 inches (46 cm) and includes a plurality of ball position markers. Preferably two such markers are used as shown in FIG. 6; the first marker, that is the marker 21 nearest the golf cup 16, is generally used. However, if the player wishes to increase the putting difficulty, the golf ball 40 may be placed on the ball position marker that is furthest from the golf cup 16.

Figure 8:
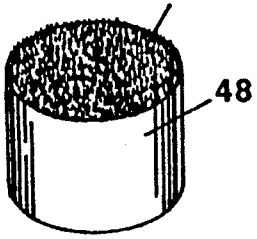
FIG. 8 is an isometric view of a golf cup plug.
Figure 9:
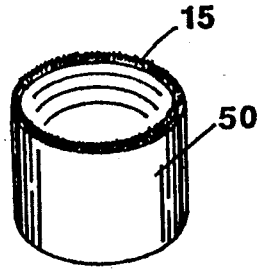
FIG. 9 is an isometric view of a target cup reduction insert.

The accuracy of the putt is determined by utilizing a first target cup 25 or a second target cup 27. As shown in FIG. 6, the first target cup 25 is aligned with the aiming line and is located near the center of the putting surface; the second target cup 27 is preferably located 6 to 12 inches (15 to 31 cm) from the back edge 44 of the putting surface. If the golf ball 40 enters the first cup, a degree of accuracy has been attained. If greater accuracy is desired, the first target cup 25 may be plugged by a golf cup plug 48, as shown in FIG. 8, that when inserted, the top of the plug is flush with the putting surface 14. Additionally, to further increase the putting difficulty and improve accuracy, a target cup reduction insert 50, as shown in FIG. 9, may be inserted into either the first or second target cups. The insert decreases the cup diameters to thus increase the difficulty factor of the device 10.

The preferred embodiment of the putting practice device 10 has a width of 16 inches (4 cm) and a length of 90 inches (231 cm). With these dimensions, the device 10 is difficult to carry and/or storage. Therefore, as shown in FIG. 6, near the center of the device 10 is located a folding hinge 52 that allows the device 10 to be folded over 180-degrees to facilitate handling and storage.

Obviously, numerous variations and modifications can be made without departing from the spirit of the present invention. Therefore, it should be clearly understood that the forms of the present invention described above and shown in the figures of the accompanying drawings are illustrative only and are not intended to limit the scope of the present invention.

I claim:

1. A putting practice device comprising:

a) a putting surface having a golf cup recessed below said surface, b) a pivot shaft extending across a portion of said cup, c) a first golf ball mounted on a rod extending from said pivot shaft and movable between a first position located on said surface adjacent one edge of said cup and a second position within said cup, d) a lever projecting from said pivot shaft and extending above said surface to facilitate movement of said first golf ball from said second position to said first position, and e) an aiming line extending along said surface and bisecting said cup.

2. The putting practice device of claim 1 further comprising a second golf ball positionable on said aiming line adjacent the edge of said cup opposite said first ball.

3. The putting practice device of claim 2 further comprising an extended putting surface having:

a) a front edge and a back edge, b) a putter alignment guide extending laterally across said extended putting surface and located behind the back of said first golf ball, c) an aiming line, that also functions as a back-stroke guide, extending longitudinally from the back edge of said extended putting surface in alignment with the center of said first golf ball and adjacent to the longitudinal outer edge of the putter alignment guide, d) a follow-through line aligned with the aiming line and extending longitudinally from the inner center edge of said golf cup for a distance of up to 18 inches (46 cm), e) a plurality of ball position markers located on the aiming line where the marker furthest from said golf cup is used when a player wishes to increase the putting difficulty, f) a first target cup aligned with the aiming line and located near the center of said putting surface, and g) a second target cup aligned with said first target cup and located 6 to 12 inches (15 to 31 cm) from the back edge of said putting surface.

4. The putting practice device of claim 3 further comprising a ball stop ledge located at the back edge of said extended putting surface.

5. The putting practice device of claim 3 further comprising a golf cup plug that is sized to fit into said first target cup.

6. The putting practice device of claim 3 further comprising a target cup reduction insert that is sized to fit into said first or second target cups, where said insert decreases the cup diameter to thus increase the difficulty factor of said device.

7. The putting practice device of claim 3 further comprising a folding hinge located laterally near the center of said extended putting surface, where said hinge allows said device to be folded over 180-degrees to facilitate handling and storage.

8. The putting practice device of claim 1 further comprising:

a) a portion of said device being removable and having a lower portion containing said cup and said pivot shaft and dimensioned to fit within a standard golf hole, and b) a flanged portion projecting radially from the upper edge of said cup and including a portion of said surface.

9. The putting practice device of claim 8 further comprising a lift-rod having an upper end with a lift knob and a lower end that is attached substantially normal to the upper surface of said golf cup by an attaching means.

10. The putting practice device of claim 1 wherein said surface is formed of artificial turf.

11. The putting practice device of claim 1 wherein said surface is formed of indoor/outdoor carpet.

12. A putting practice device comprising:

a) a flanged portion having a putting surface and formed with a golf cup recessed below said surface, b) a pivot shaft extending across a portion of said cup, c) a golf ball mounted on a rod extending from said pivot shaft and movable between a first position located on said surface adjacent one edge of said cup and a second position within said cup, d) a lever projecting from said pivot shaft and extending above said surface to facilitate movement of said golf ball from said second position to said first position, e) an aiming line extending along said surface and bisecting said cup, and f) a lower portion containing said cup and said pivot shaft and dimensioned to fit within a standard golf hole.

* * * * *